US010533586B2

(12) United States Patent
Fujiwara

(10) Patent No.: US 10,533,586 B2
(45) Date of Patent: Jan. 14, 2020

(54) CYLINDER OPERATING CONDITION MONITORING DEVICE

(71) Applicant: SMC CORPORATION, Chiyoda-ku (JP)

(72) Inventor: Atsushi Fujiwara, Moriya (JP)

(73) Assignee: SMC CORPORATION, Chiyoda-ku (JP)

( * ) Notice: Subject to any disclaimer, the term of this patent is extended or adjusted under 35 U.S.C. 154(b) by 104 days.

(21) Appl. No.: 15/722,693

(22) Filed: Oct. 2, 2017

(65) Prior Publication Data

US 2018/0094654 A1 Apr. 5, 2018

(30) Foreign Application Priority Data

Oct. 3, 2016 (JP) ..... 2016-195558

(51) Int. Cl.
*F15B 15/28* (2006.01)
*F15B 15/14* (2006.01)

(52) U.S. Cl.
CPC ..... *F15B 15/28* (2013.01); *F15B 15/14* (2013.01)

(58) Field of Classification Search
CPC ... F15B 15/28; F15B 15/2815; F15B 15/2838
USPC ..... 91/1; 92/5 R
See application file for complete search history.

(56) References Cited

U.S. PATENT DOCUMENTS 7,353,743 B2 4/2008 Bugel
7,387,061 B2 * 6/2008 Kobata ..... F15B 15/222 60/461
7,827,787 B2 11/2010 Cherney
10,072,676 B2 9/2018 Afshari
2003/0187595 A1 10/2003 Koshinaka et al.
2004/0261608 A1 12/2004 Bugel
2007/0209503 A1 9/2007 Pfaff
2012/0131912 A1 5/2012 Fukui
2015/0007713 A1 1/2015 Aki
2015/0354172 A1 12/2015 Hijikata
2016/0298659 A1 * 10/2016 Batenburg ..... F15B 15/2838
2018/0266415 A1 9/2018 Afshari

FOREIGN PATENT DOCUMENTS

JP 56-39850 A 4/1981
JP 7-182049 A 7/1995
JP 2003-71600 A 3/2003
JP 2003-294503 A 10/2003
JP 3857187 12/2006
JP 2010-71349 A 4/2010
JP 2010-159783 A 7/2010
JP 5331986 B2 10/2013
JP 2015-14990 1/2015

* cited by examiner

*Primary Examiner* — Michael Leslie

(74) *Attorney, Agent, or Firm* — Oblon, McClelland, Maier & Neustadt, L.L.P.

(57) ABSTRACT

A monitoring device including a microcomputer of a detector that calculates a first time derivative value by differentiating a first pressure value with respect to time, and/or calculates a second time derivative value by differentiating a second pressure value with respect to time. In addition, based on at least one from among the first time derivative value and the second time derivative value, the microcomputer determines whether or not the piston has arrived at one end or another end inside the cylinder main body.

4 Claims, 5 Drawing Sheets

CYLINDER OPERATING CONDITION MONITORING DEVICE

CROSS-REFERENCE TO RELATED APPLICATION

This application is based upon and claims the benefit of priority from Japanese Patent Application No. 2016-195558 filed on Oct. 3, 2016, the contents of which are incorporated herein by reference.

BACKGROUND OF THE INVENTION

Field of the Invention

The present invention relates to a cylinder operating condition monitoring device for a cylinder, which includes a cylinder main body, a piston capable of undergoing reciprocating motion between one end and another end in the interior of the cylinder main body, and a piston rod connected integrally with the piston.

Description of the Related Art

A cylinder includes a cylinder main body, a piston that undergoes reciprocating motion between one end and another end inside the cylinder main body, and a piston rod connected integrally with the piston. A first cylinder chamber is formed between the piston and the one end in the interior of the cylinder main body, and a second cylinder chamber is formed between the piston and the other end in the interior of the cylinder main body. In this instance, by supplying a fluid from a fluid supply source to the first cylinder chamber, or by supplying the fluid to the second cylinder chamber, the piston and the piston rod are made to undergo reciprocating motion between the one end and the other end inside the cylinder main body. In Japanese Patent No. 3857187, a cylinder of this type is disclosed, in which a magnet is incorporated in the piston rod, and position detecting sensors which detect magnetism from the magnet are disposed at the one end and the other end of the cylinder main body.

SUMMARY OF THE INVENTION

However, with the technique of Japanese Patent No. 3857187, since the position detecting sensors are installed in the vicinity of the cylinder, in the case that the cylinder were used, for example, as equipment related to food preparation, and if the cylinder were brought into contact with a cleaning liquid for such food or the like, a possibility exists that the position detecting sensors and associated wiring for the position detecting sensors could become corroded. Thus, if it were attempted to ensure liquid resistance of the position detecting sensors and the wiring therefor, costs would rise.

Accordingly, there is a need to be capable of detecting the arrival of the piston, which is undergoing reciprocating motion in the interior of the cylinder main body, at the one end or the other end, even in an environment in which a sensor cannot be installed on the cylinder.

The present invention has been devised as a solution to the aforementioned problems, and an object of the present invention is to provide a cylinder operating condition monitoring device, in which it is possible to detect the arrival of the piston at the one end or the other end of the cylinder main body, without requiring a sensor to be installed in the vicinity of the cylinder.

The present invention relates to an operating condition monitoring device for a cylinder, in which a first cylinder chamber is formed between a piston and one end in the interior of a cylinder main body, a second cylinder chamber is formed between the piston and another end in the interior of the cylinder main body, and fluid is supplied from a fluid supply source to the first cylinder chamber, or fluid is supplied from the fluid supply source to the second cylinder chamber, whereby the piston which is connected to a piston rod undergoes reciprocating motion between the one end and the other end inside the cylinder main body.

In addition, in order to realize the aforementioned object, the operating condition monitoring device for a cylinder according to the present invention further includes a determination unit adapted to determine, based on a time derivative value of a pressure of the first cylinder chamber or the second cylinder chamber, whether or not the piston has arrived at the one end or the other end inside the cylinder main body.

When the piston has arrived at the one end or the other end inside the cylinder main body, due to the fluid being discharged from the first cylinder chamber or the second cylinder chamber, or the fluid being supplied from the fluid supply source, the pressure in the first cylinder chamber or the second cylinder chamber changes along with the elapse of time.

Thus, according to the present invention, attention is focused on such changes over time of the pressure, and based on a time derivative value of the pressure of the first cylinder chamber or the second cylinder chamber, a determination is made as to whether or not the piston has arrived at the one end or the other end inside the cylinder main body. More specifically, using the time derivative value of the pressure of at least one of the cylinder chambers, the arrival of the piston at the one end or the other end inside the cylinder main body is determined.

In this case, if the pressure in the fluid supply path from the fluid supply source to the first cylinder chamber or the second cylinder chamber is detected, it becomes possible to detect the pressure of the first cylinder chamber or the second cylinder chamber. Therefore, it is unnecessary to install a sensor in the vicinity of the cylinder for detecting the pressure. Consequently, according to the present invention, it is possible to detect the arrival of the piston at the one end or the other end inside the cylinder main body without installing a sensor in the vicinity of the cylinder.

In this instance, the operating condition monitoring device further includes a first pressure detection unit adapted to detect a first pressure value inside a first tube that supplies fluid to or discharges fluid from the first cylinder chamber, and/or a second pressure detection unit adapted to detect a second pressure value inside a second tube that supplies fluid to or discharges fluid from the second cylinder chamber. In this case, the determination unit may determine whether or not the piston has arrived at the one end or the other end inside the cylinder main body, on the basis of a time derivative value of the first pressure value, which is dependent on the pressure of the first cylinder chamber, and/or a time derivative value of the second pressure value, which is dependent on the pressure of the second cylinder chamber.

In this manner, because the first pressure detection unit is provided in the first tube, whereas the second pressure detection unit is provided in the second tube, it is unnecessary to install sensors, as well as wiring for such sensors, in the vicinity of the cylinder. As a result, it is possible for the cylinder to be used suitably in facilities related to food preparation, and it is possible to avoid the occurrence of corrosion or the like of sensors and wiring in a cleaning process for the facilities.

Further, in order to deal with changes in the detection level due to variations in accuracy and temperature characteristics of the first pressure detection unit that senses the first pressure value and the second pressure detection unit that senses the second pressure value, it is possible to prevent the determination result of the determination unit from being adversely influenced by variations or the like, by determining whether or not the piston has reached the one end or the other end inside the cylinder main body based on the time derivative value of the first pressure value and/or the second pressure value.

In this case, the determination unit may determine that the piston has arrived at the one end or the other end inside the cylinder main body, from a change in the time derivative value when the first pressure value and the second pressure value change to a pressure value on a side open to atmosphere. When the first pressure value or the second pressure value changes to a pressure value on a side open to atmosphere, the time derivative value abruptly changes along with the elapse of time. By perceiving such an abrupt change, it is possible to more accurately detect that the piston has arrived at the one end or the other end inside the cylinder main body.

Alternatively, the determination unit may determine that the piston has arrived at the one end or the other end inside the cylinder main body, from a change in the time derivative value when either one from among the first pressure value and the second pressure value changes to a pressure value of the fluid supplied by the fluid supply source, or a pressure value on a side open to atmosphere. The time derivative value changes along with the elapse of time, when either one of the pressure values changes to a pressure value of the fluid supplied by the fluid supply source, or a pressure value on a side open to atmosphere. Thus, by perceiving such a change, it is possible to detect with good accuracy that the piston has arrived at the one end or the other end inside the cylinder main body.

The above and other objects, features, and advantages of the present invention will become more apparent from the following description when taken in conjunction with the accompanying drawings, in which a preferred embodiment of the present invention is shown by way of illustrative example.

DESCRIPTION OF THE PREFERRED EMBODIMENTS

A preferred embodiment of a cylinder operating condition monitoring device according to the present invention will be described in detail below with reference to the drawings.

[1. Configuration of the Present Embodiment]

Figure 1:
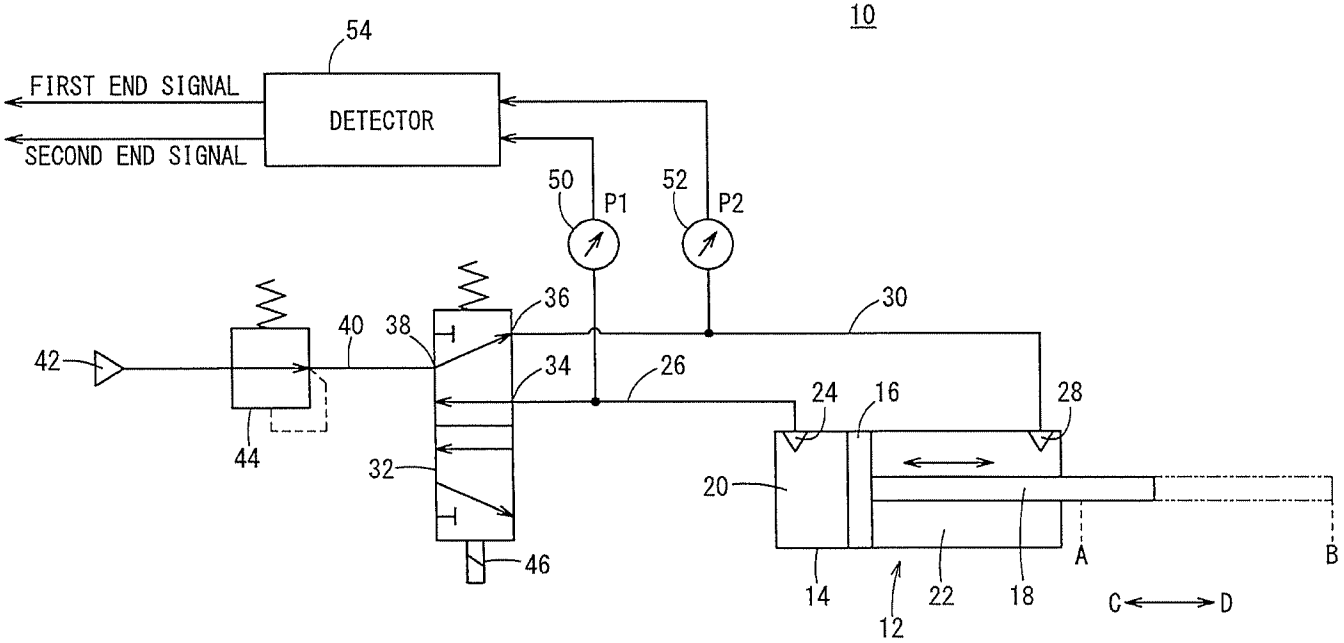
FIG. 1 is a block diagram of a monitoring device according to a present embodiment.

FIG. 1 is a block diagram of a cylinder operating condition monitoring device 10 (hereinafter, also referred to simply as a "monitoring device 10") according to the present embodiment. The monitoring device 10 functions as a device for monitoring the operating condition of a cylinder 12.

The cylinder 12 includes a cylinder main body 14, a piston 16 disposed movably in the interior of the cylinder main body 14, and a piston rod 18 that is connected to the piston 16. In this case, in the interior of the cylinder main body 14, a first cylinder chamber 20 is formed between the piston 16 and one end shown on the left side in FIG. 1, and a second cylinder chamber 22 is formed between the piston 16 and another end shown on the right side in FIG. 1.

Moreover, as shown in FIG. 1, the piston rod 18 is connected to a side surface of the piston 16 that faces toward the second cylinder chamber 22, and the distal end of the piston rod 18 extends outwardly from the right end of the cylinder main body 14. Therefore, it can be understood that the cylinder 12 is a single shaft type of cylinder.

A first port 24 is formed on a side surface of the cylinder main body 14 on the side of the first cylinder chamber 20, and one end part of a first tube 26 is connected to the first port 24. On the other hand, a second port 28 is formed on a side surface of the cylinder main body 14 on the side of the second cylinder chamber 22, and one end part of a second tube 30 is connected to the second port 28.

Another end part of the first tube 26 is connected to a first connection port 34 of a changeover valve 32. Further, another end part of the second tube 30 is connected to a second connection port 36 of the changeover valve 32. A supply tube 40 is connected to a supply port 38 of the changeover valve 32. The supply tube 40 is connected to a fluid supply source 42, and a pressure reducing valve 44 is provided at a midway location in the supply tube 40.

The changeover valve 32 is a five port single acting type of solenoid valve, and is driven by command signals (currents) being supplied to a solenoid 46 from the exterior.

More specifically, when a command signal is not supplied to the solenoid 46, the supply port 38 and the second connection port 36 communicate with each other, together with the first connection port 34 being opened to the exterior. Consequently, the fluid supplied from the fluid supply source 42 is converted into a predetermined pressure by the pressure reducing valve 44, and is supplied via the supply tube 40 to the supply port 38 of the changeover valve 32. The pressure-converted fluid (pressure fluid) is supplied to the second cylinder chamber 22 via the supply port 38, the second connection port 36, the second tube 30, and the second port 28.

As a result, the piston 16 is pressed by the pressure fluid toward the side of the first cylinder chamber 20, and moves in the direction of the arrow C. Together therewith, the fluid (pressure fluid) inside the first cylinder chamber 20, which is pressed by the piston 16, is discharged to the exterior from the first port 24 via the first tube 26, the first connection port 34, and the changeover valve 32.

On the other hand, when a command signal is supplied to the solenoid 46, the supply port 38 and the first connection port 34 communicate with each other, together with the second connection port 36 being opened to the exterior. Consequently, the pressure fluid that was supplied from the fluid supply source 42, and which was converted into a predetermined pressure by the pressure reducing valve 44, is supplied to the first cylinder chamber 20 from the supply tube 40, via the supply port 38, the first connection port 34, the first tube 26, and the first port 24.

As a result, the piston 16 is pressed by the pressure fluid toward the side of the second cylinder chamber 22, and moves in the direction of the arrow D. Together therewith, the fluid inside the second cylinder chamber 22, which is pressed by the piston 16, is discharged to the exterior from the second port 28 via the second tube 30, the second connection port 36, and the changeover valve 32.

In this manner, due to the switching operation of the changeover valve 32, the pressure fluid is supplied from the fluid supply source 42 to the first cylinder chamber 20 via the first tube 26, or the pressure fluid is supplied from the fluid supply source 42 to the second cylinder chamber 22 via the second tube 30, whereby the piston 16 and the piston rod 18 are capable of undergoing reciprocal motion in the direction of the arrow C and the direction of the arrow D. More specifically, the cylinder 12 is a double acting type of cylinder.

Moreover, in the present embodiment, a distal end position of the piston rod 18 when the piston 16 has moved to the one end in the direction of the arrow C in the interior of the cylinder main body 14 is defined as a position A, whereas the distal end position of the piston rod 18 when the piston 16 has moved to the other end in the direction of the arrow D in the interior of the cylinder main body 14 is defined as a position B. Further, in the following description, a case in which the piston 16 moves from one end to the other end inside the cylinder main body 14 along the direction of the arrow D at a time that current is supplied to the solenoid 46 (when the changeover valve 32 is on) is also referred to as "advancing". Furthermore, in the case that the piston 16 reaches the other end inside the cylinder main body 14, and the distal end position of the piston rod 18 arrives at the position B, the other end, which is a stroke end, and the position B are both referred to as a "first end".

On the other hand, in the following description, a case in which the piston 16 moves from the other end to the one end inside the cylinder main body 14 along the direction of the arrow C at a time that current is not supplied to the solenoid 46 (when the changeover valve 32 is off) is also referred to as "retracting". Further, in the case that the piston 16 reaches the one end inside the cylinder main body 14, and the distal end position of the piston rod 18 arrives at the position A, the one end, which is a stroke end, and the position A are both referred to as a "second end".

Further, in the present embodiment, the changeover valve 32 is not limited to being the solenoid valve shown in FIG. 1, but may be another known type of solenoid valve. Further, in place of a single acting solenoid valve, for the changeover valve 32, a well known type of double acting solenoid valve may also be used. In the description to be given below, a case will be described in which the five port single acting type of solenoid valve shown in FIG. 1 serves as the changeover valve 32.

In a case in which the cylinder 12 is configured in the foregoing manner, in addition to the fluid supply source 42, the pressure reducing valve 44, and the changeover valve 32, etc., the monitoring device 10 according to the present embodiment further includes a first pressure sensor 50 (first pressure detection unit), a second pressure sensor 52 (second pressure detection unit), and a detector 54.

The first pressure sensor 50 sequentially detects a pressure value (first pressure value) P1 of the pressure fluid inside the first tube 26, and outputs to the detector 54 a first pressure signal corresponding to the detected first pressure value P1. The second pressure sensor 52 sequentially detects a pressure value (second pressure value) P2 of the pressure fluid inside the second tube 30, and outputs to the detector 54 a second pressure signal corresponding to the detected second pressure value P2.

Moreover, because the first tube 26 is connected to the first cylinder chamber 20, the first pressure value P1 is a pressure value that corresponds to pressure in the first cylinder chamber 20. Further, because the second tube 30 is connected to the second cylinder chamber 22, the second pressure value P2 is a pressure value that corresponds to pressure in the second cylinder chamber 22. Furthermore, various known pressure detecting means can be adopted for the first pressure sensor 50 and the second pressure sensor 52, however, descriptions of these pressure detecting means will be omitted.

In the case that the first pressure signal and the second pressure signal are sequentially input into the detector 54, then on the basis of the first pressure value P1 corresponding to the first pressure signal, and the second pressure value P2 corresponding to the second pressure signal, the detector 54 determines whether or not the piston 16 has reached the one end (second end) or the other end (first end) of the cylinder main body 14. As a result of such a determination process, the detector 54 outputs a signal (first end signal) indicating that the piston 16 has reached the first end, or a signal (second end signal) indicating that the piston 16 has reached the second end.

The aforementioned determination processes, which are carried out in the detector 54, will be described in detail later.

Figure 2:
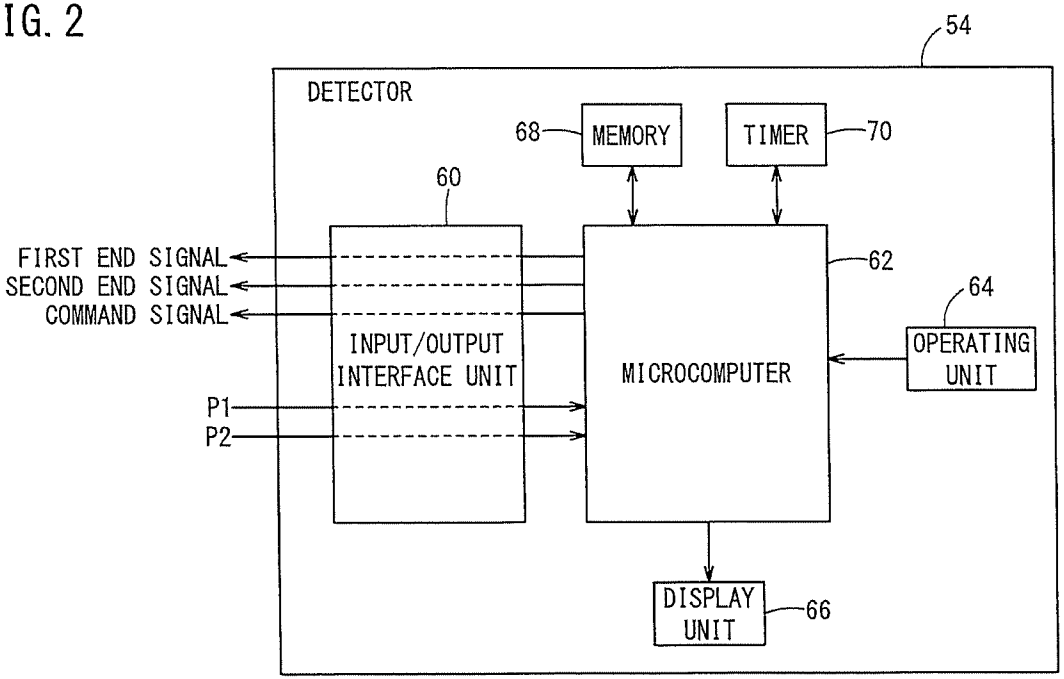
FIG. 2 is a block diagram showing an internal configuration of a detector shown in FIG. 1.

FIG. 2 is a block diagram showing an internal configuration of the detector 54. The detector 54 generates the first end signal or the second end signal by carrying out a predetermined digital signal process (determination process) using the first pressure signal and the second pressure signal.

The detector 54 includes an input/output interface unit 60, a microcomputer 62 (determination unit), an operating unit 64, a display unit 66, a memory 68 and a timer 70.

The input/output interface unit 60 successively acquires the first pressure signal and the second pressure signal, and outputs to the microcomputer 62 the first pressure value P1 indicated by the first pressure signal, and the second pressure value P2 indicated by the second pressure signal. Further, as will be described later, in the case that the microcomputer 62 generates the first end signal or the second end signal on the basis of the first pressure value P1 and the second pressure value P2, the input/output interface unit 60 outputs the first end signal or the second end signal to the exterior.

The operating unit 64 is an operating means such as an operating panel and an operating button or the like, which are operated by a user of the monitoring device 10 and the cylinder 12. By operating the operating unit 64, the user can set predetermined values, which are necessary for the digital signal process (determination process) carried out by the microcomputer 62. Moreover, the setting operation is implemented by the user constructing a system including the monitoring device 10 and the cylinder 12, etc., and thereafter, during a trial operation, by the user operating the operating unit 64 while setting the operating conditions for the cylinder 12. Alternatively, each of the reference values may be set or changed through the input/output interface unit 60 by way of communications with the exterior or the like.

The microcomputer 62 performs time differentiation with respect to the first pressure value P1 or the second pressure value P2, which are sequentially input thereto from the input/output interface unit 60, whereby a first time derivative value dP1 of the first pressure value P1 or a second time derivative value dP2 of the second pressure value P2 is calculated. Since the first time derivative value dP1 or the second time derivative value dP2 is a derivative taken over time of the first pressure value P1 or the second pressure value P2, such a value should originally be expressed in the form of dP1/dt or dP2/dt, however, in order to simplify the description, such a value is denoted as dP1 or dP2. Moreover, the first time derivative value dP1 or the second time derivative value dP2 can be calculated by a well-known differential calculus based method of numerical calculation.

In addition, the microcomputer 62 investigates whether or not the calculated first time derivative value dP1 or the second time derivative value dP2 has undergone an abrupt change in a positive direction or a negative direction with respect to an elapse of time, and determines the point in time when the first time derivative value Dp1 or the second time derivative value dP2 undergoes an abrupt change, and the absolute value |dP1| or |dP2| thereof becomes maximum (a point when the maximum value is reached in a positive direction or a negative direction) to be a point in time at which the piston 16 has arrived at the one end (second end) or the other end (first end) of the cylinder main body 14.

As a result, in the case that the piston 16 has arrived at the other end inside the cylinder main body 14, the microcomputer 62 generates the first end signal, which indicates that the piston 16 and the piston rod 18 have arrived at the first end. On the other hand, in the case that the piston 16 has arrived at the one end inside the cylinder main body 14, the microcomputer 62 generates the second end signal, which indicates that the piston 16 and the piston rod 18 have arrived at the second end. The generated first end signal or the generated second end signal is output to the exterior via the input/output interface unit 60.

Further, via the input/output interface unit 60, the microcomputer 62 is capable of supplying command signals to the solenoid 46 of the changeover valve 32. The display unit 66 displays the predetermined values that were set by the user operating the operating unit 64, or displays the results of determination processes performed by the microcomputer 62. The memory 68 stores the predetermined values that were set by the operation unit 64.

The timer 70 begins time measurement at a point in time at which supply of the command signal from the microcomputer 62 to the solenoid 46 is started, and the measured value from such a point in time until the piston 16 arrives at the first end is stored as a movement time T in the memory 68. Alternatively, the timer 70 may begin time measurement at a point in time at which supply of the command signal is halted, and the measured value from such a point in time until the piston 16 arrives at the second end may be stored as the movement time T in the memory 68.

[2. Operations of the Present Embodiment]

The monitoring device 10 according to the present embodiment is basically configured in the manner described above. Next, operations of the monitoring device 10 will be described with reference to FIGS. 3 to 5. Along with this description, as necessary, reference may also be made to FIGS. 1 and 2.

A case will be described herein, in which the microcomputer 62 of the detector 54 determines whether or not the piston 16 has reached the one end or the other end inside the cylinder main body 14, on the basis of the first time derivative value dP1 or the second time derivative value dP2.

Figure 3:
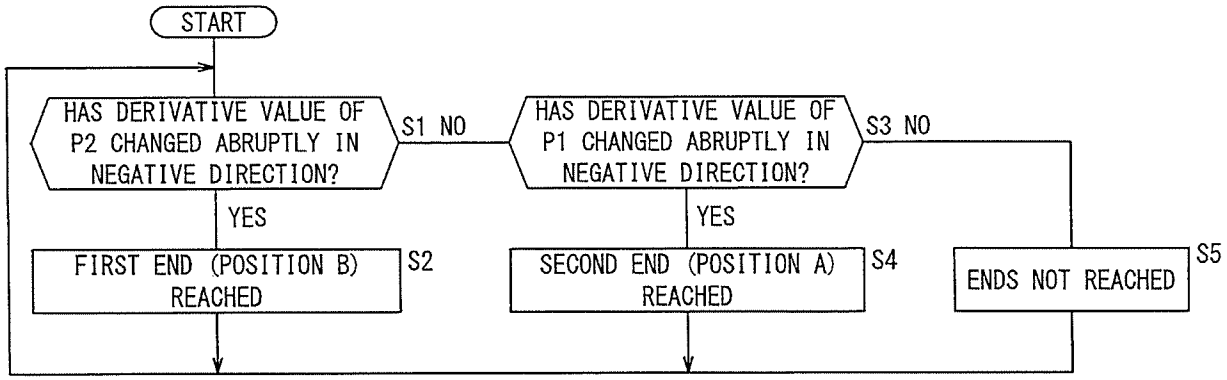
FIG. 3 is a flowchart of the present embodiment.
Figure 4:
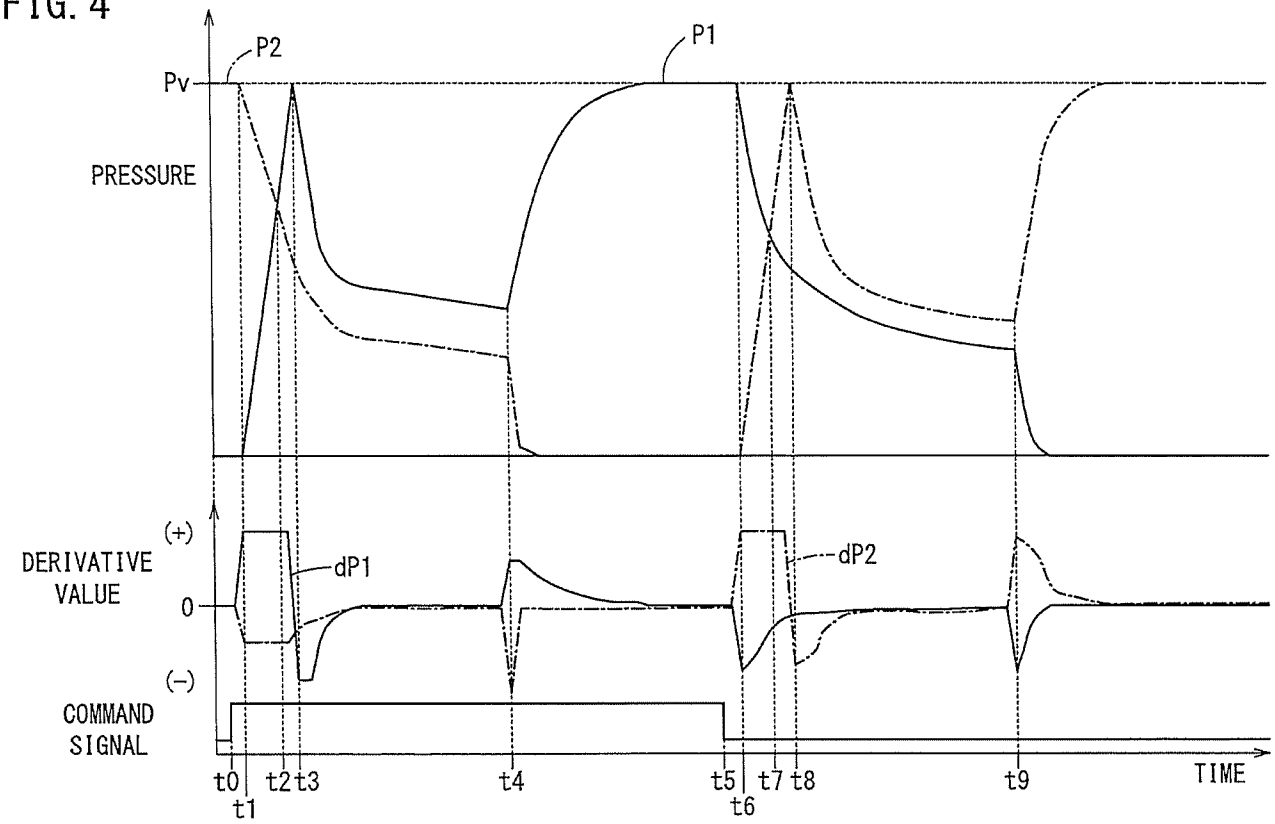
FIG. 4 is a timing chart showing changes over time of a first pressure value, a second pressure value, a derivative value, and a command signal.
Figure 5:
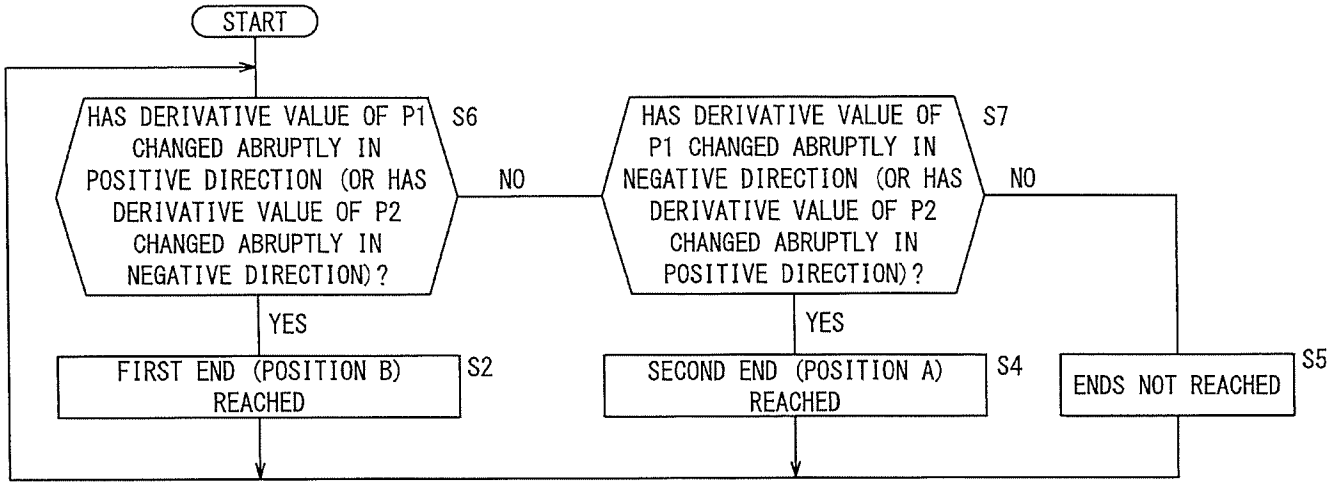
FIG. 5 is a modification of the flowchart of FIG. 3.

FIG. 3 is a flowchart showing the determination process carried out by the microcomputer 62. FIG. 4 is a timing chart showing changes over time of the first pressure value P1, the second pressure value P2, the first time derivative value dP1, the second time derivative value dP2, and the command signal when the piston 16 and the piston rod 18 undergo reciprocating motion in the direction of the arrow D and the direction of the arrow C in the cylinder 12 of FIG. 1. FIG. 5 is a flowchart showing a modification of the determination process of FIG. 3. The determination processes of FIGS. 3 and 5 will be described after first explaining the timing chart of FIG. 4.

In the case of an advancing operation of the piston 16, as shown in FIG. 4, when the changeover valve 32 of FIG. 1 is off (in a time zone prior to time t0), pressure fluid is supplied from the fluid supply source 42 to the second cylinder chamber 22 via the pressure reducing valve 44, the supply port 38, the second connection port 36, and the second tube 30. As a result, the piston 16 is pressed toward the one end in the interior of the cylinder main body 14. On the other hand, since the first cylinder chamber 20 communicates with the atmosphere via the first tube 26 and the first connection port 34, the fluid in the first cylinder chamber 20 is discharged from the first tube 26 via the changeover valve 32. Accordingly, in the time zone prior to time t0, the first pressure value P1 is substantially zero (the pressure value on the side open to the atmosphere), and the second pressure value P2 is a predetermined pressure value (the pressure value Pv of the pressure fluid that is output from the pressure reducing valve 44).

Next, at time t0, when a command signal is supplied from the microcomputer 62 in FIG. 2 to the solenoid 46, the changeover valve 32 is driven and turned on. As a result, the connection state of the changeover valve 32 is switched, and supply of pressure fluid is started from the fluid supply source 42 to the first cylinder chamber 20 via the pressure reducing valve 44, the supply port 38, the first connection port 34, and the first tube 26. On the other hand, the second cylinder chamber 22 communicates with the atmosphere via the second tube 30 and the second connection port 36, whereby the pressure fluid inside the second cylinder chamber 22 starts to be discharged to the exterior from the second tube 30 via the changeover valve 32.

Consequently, from time t1, the first pressure value P1 of the pressure fluid in the first tube 26 rapidly increases along with the elapse of time and together therewith, the second pressure value P2 of the pressure fluid in the second tube 30 decreases rapidly along with the elapse of time. At time t2, the first pressure value P1 surpasses the second pressure value P2.

Thereafter, at time t3, the first pressure value P1 rises to a predetermined pressure value (for example, the second pressure value P2 (pressure value Pv) before time t1), whereupon the piston 16 starts to advance in the direction of the arrow D. In this case, when the piston 16 begins advancing in the direction of the arrow D, due to a volume change of the first cylinder chamber 20, the first pressure value P1 decreases from the pressure value Pv, and together therewith, the second pressure value P2 also decreases.

Moreover, in FIG. 4, although an example is illustrated in which the first pressure value P1 rises to the pressure value Pv at time t3, in actuality, cases exist in which the piston 16 starts to advance in the direction of the arrow D before the first pressure value P1 rises to the pressure value Pv. In the following descriptions, cases will be explained in which the piston 16 starts to advance or retract after the first pressure value P1 or the second pressure value P2 has risen to the pressure value Pv or a value in close proximity thereto.

During advancement of the piston 16, due to volume changes of the first cylinder chamber 20 and the second cylinder chamber 22, the first pressure value P1 and the second pressure value P2 gradually decrease together with the elapse of time. In this case, the first pressure value P1 and the second pressure value P2 decrease while maintaining a substantially constant first differential pressure (=P1−P2).

When the piston 16 reaches the other end (first end) inside the cylinder main body 14 at time t4, the volume of the second cylinder chamber 22 becomes substantially zero. Therefore, after time t4, the second pressure value P2 drops to substantially zero (atmospheric pressure), together with the first pressure value P1 rising to the pressure value Pv. More specifically, when the piston 16 reaches the other end inside the cylinder main body 14, the first differential pressure increases rapidly from a constant value.

Then, at time t5, when supply of the command signal from the microcomputer 62 in FIG. 2 to the solenoid 46 is suspended, driving of the changeover valve 32 is stopped and the changeover valve 32 is turned off. As a result, due to a spring restorative force of the changeover valve 32, the connection state of the changeover valve 32 is switched, and supply of pressure fluid is started from the fluid supply source 42 to the second cylinder chamber 22 via the pressure reducing valve 44, the supply port 38, the second connection port 36, and the second tube 30. On the other hand, the first cylinder chamber 20 communicates with the atmosphere via the first tube 26 and the first connection port 34, whereby the pressure fluid inside the first cylinder chamber 20 starts to be discharged to the exterior from the first tube 26 via the changeover valve 32.

Consequently, from time t6, the second pressure value P2 of the pressure fluid in the second tube 30 rapidly increases along with the elapse of time. On the other hand, the first pressure value P1 of the pressure fluid in the first tube 26 rapidly decreases from time t6 along with the elapse of time. As a result, at time t7, the second pressure value P2 surpasses the first pressure value P1.

Thereafter, at time t8, the second pressure value P2 rises to a predetermined pressure value (for example, the pressure value Pv), whereupon the piston 16 starts to retract in the direction of the arrow C. In this case, due to a volume change of the second cylinder chamber 22, the second pressure value P2 decreases from the pressure value Pv, and together therewith, the first pressure value P1 also decreases.

During retraction of the piston 16, due to volume changes of the first cylinder chamber 20 and the second cylinder chamber 22, the first pressure value P1 and the second pressure value P2 gradually decrease together with the elapse of time. In this case, the first pressure value P1 and the second pressure value P2 decrease while maintaining a substantially constant second differential pressure (=P2−P1).

The absolute value |P1−P2| of the first differential pressure in the advancing operation and the absolute value |P2−P1| of the second differential pressure in the retracting operation are of different magnitudes from each other. This is caused by the fact that the piston rod 18 is connected to the side surface (right side surface) of the piston 16 in the second cylinder chamber 22 of FIG. 1, whereby the pressure receiving areas differ between the right side surface and the other side surface (left side surface) of the piston 16 in the first cylinder chamber 20.

When the piston 16 reaches the one end inside the cylinder main body 14 at time t9, the volume of the first cylinder chamber 20 becomes substantially zero. Therefore, after time t9, the first pressure value P1 drops to substantially zero (atmospheric pressure), together with the second pressure value P2 rising to the pressure value Pv. More specifically, when the piston 16 reaches the one end inside the cylinder main body 14, the second differential pressure increases rapidly from a constant value.

On the other hand, the first time derivative value dP1 and the second time derivative value dP2 are derivatives taken over time of the first pressure value P1 and the second pressure value P2, which change with time in the following manner.

More specifically, in the case that the first pressure value P1 and the second pressure value P2 rise or fall along with the elapse of time, the first time derivative value dP1 and the second time derivative value dP2 change in a positive direction or a negative direction. Further, in the case that the first pressure value P1 and the second pressure value P2 change at a constant rate along with the elapse of time, or if there is no change therein with respect to the elapse of time, the first time derivative value dP1 and the second time derivative value dP2 remain at a value of substantially zero.

More specifically, first, a description will be given concerning a time of forward or advancing movement of the piston 16.

In a time band from time t0 to time t3, the first time derivative value dP1 changes in a positive direction accompanying an abrupt rise in the first pressure value P1. Next, immediately after time t3, the first time derivative value dP1 changes in a negative direction accompanying an abrupt decrease in the first pressure value P1. Thereafter, the first time derivative value dP1 remains at a value of substantially zero. In addition, when the first pressure value P1 rises at time t4, the first time derivative value dP1 changes in a positive direction, and thereafter, when the first pressure value P1 becomes saturated at a predetermined pressure value (pressure value Pv), the first time derivative value decreases to a value of substantially zero.

On the other hand, since the second pressure value P2 abruptly decreases in the time band from time t0 to time t3, the second time derivative value dP2 changes in a negative direction. Thereafter, the second time derivative value dP2 remains at a value of substantially zero. In addition, when the second pressure value P2 abruptly decreases to atmospheric pressure at time t4, the second time derivative value dP2 suddenly changes in a negative direction, and thereafter, changes to a value of substantially zero.

Next, a description will be given concerning a time of rearward or retracting movement of the piston 16.

Since the first pressure value P1 abruptly decreases in the time band from time t5 to time t8, the first time derivative value dP1 changes in a negative direction. Thereafter, the first time derivative value dP1 remains at a value of substantially zero. In addition, when the first pressure value P1 abruptly decreases to atmospheric pressure at time t9, the first time derivative value dP1 suddenly changes in a negative direction, and thereafter, changes to a value of substantially zero.

On the other hand, in a time band from time t5 to time t8, the second time derivative value dP2 changes in a positive direction accompanying an abrupt rise in the second pressure value P2. Further, immediately after time t8, the second time derivative value dP2 changes in a negative direction accompanying an abrupt decrease in the second pressure value P2. Thereafter, the second time derivative value dP2 remains at a value of substantially zero. Then, when the second pressure value P2 rises at time t9, the second time derivative value dP2 changes in a positive direction, and thereafter, decreases to a value of substantially zero.

In addition, in the present embodiment, during reciprocating motion of the piston 16, by perceiving a change in a positive direction or a negative direction of the aforementioned first time derivative value dP1 or the second time derivative value dP2, it is determined whether or not the piston 16 has reached the one end (second end) or the other end (first end) inside the cylinder main body 14.

More specifically, the first pressure value P1, which is detected by the first pressure sensor 50 of FIG. 1, and the second pressure value P2, which is detected by the second pressure sensor 52, are input sequentially to the microcomputer 62 via the input/output interface unit 60 shown in FIG. 2. Thus, with each time that the first pressure value P1 and the second pressure value P2 are input thereto, the microcomputer 62 executes the determination process shown in FIG. 3.

In FIG. 3, a process is illustrated for determining the arrival of the piston 16 at the one end or the other end inside the cylinder main body 14, by perceiving sudden changes in a negative direction of the first time derivative value dP1 and the second time derivative value dP2.

More specifically, in step S1 of FIG. 3, the microcomputer 62 calculates the second time derivative value dP2 from the change over time of the second pressure value P2, which is input sequentially thereto, and determines whether or not the second time derivative value dP2 has undergone an abrupt change in a negative direction. As a method of calculating the second time derivative value dP2, for example, the second time derivative value dP2 can be easily calculated by first obtaining a difference between a previous value and a current value of the second pressure value P2, and then dividing such a difference by the difference in time between the input time of the previous value and the input time of the current value.

In the case that the second time derivative value dP2 has undergone an abrupt change in a negative direction (step S1: YES), then in the following step S2, the microcomputer 62 determines that the piston 16 advances from the one end toward the other end inside the cylinder main body 14, and determines that the piston 16 has reached the other end (the piston rod 18 has arrived at the position B) at time t4, when the second time derivative value dP2 abruptly changes in a negative direction, and the absolute value thereof becomes maximum.

Then, the microcomputer 62 generates the first end signal which indicates that the piston 16 has arrived at the other end, and outputs the first end signal to the exterior via the input/output interface unit 60. Further, the microcomputer 62 displays the determination result on the display unit 66, and notifies the user concerning the arrival of the piston 16 at the first end.

On the other hand, in the case that a sudden change in a negative direction of the second time derivative value dP2 is not occurring in step S1 (step S1: NO), then in the following step S3, the microcomputer 62 calculates the first time derivative value dP1 using the first pressure value P1, by the same method of calculation used with the above-described second time derivative value dP2, and determines whether or not the first time derivative value dP1 has undergone an abrupt change in a negative direction.

In the case that the first time derivative value dP1 has undergone an abrupt change in a negative direction (step S3: YES), then in the following step S4, the microcomputer 62 determines that the piston 16 retracts from the other end toward the one end inside the cylinder main body 14, and determines that the piston 16 has reached the one end (the piston rod 18 has arrived at the position A) at time t9, when the first time derivative value dP1 abruptly changes in a negative direction, and the absolute value thereof becomes maximum.

Then, the microcomputer 62 generates the second end signal which indicates that the piston 16 has arrived at the one end, and outputs the second end signal to the exterior via the input/output interface unit 60. Further, the microcomputer 62 displays the determination result on the display unit 66, and notifies the user concerning the arrival of the piston 16 at the second end.

In the case that a sudden change in a negative direction of the first time derivative value dP1 is not occurring (step S3: NO), then in the following step S5, the microcomputer 62 determines that the piston 16 has not reached the one end or the other end inside the cylinder main body 14 (the piston 16 remains at a location between the one end and the other end).

In addition, in the present embodiment, during reciprocating motion of the piston 16, at each time that the first pressure value P1 and the second pressure value P2 are input thereto, the microcomputer 62 repeatedly executes the determination process of FIG. 3, and determines whether or not the piston 16 has reached the one end or the other end inside the cylinder main body 14.

Moreover, as shown in FIG. 4, during one reciprocating motion of the piston 16, the first time derivative value dP1 and the second time derivative value dP2 change a plurality of times in a positive direction or in a negative direction. For example, apart from times t4 and t9, the first time derivative value dP1 also changes in a negative direction at times t3 and t6, and the second time derivative value dP2 changes in a negative direction at times t1 and t8. Since times t1, t3, t6, and t8 are not points in time at which the piston 16 has reached the one end or the other end inside the cylinder main body 14, there is a need to prevent the microcomputer 62 from making an erroneous determination at times t1, t3, t6, and t8.

Therefore, preferably, the following filtering processes (first through third processes) are performed, so that the microcomputer 62 excludes times t1, t3, t6, and t8 from acting as determination targets.

More specifically, the change in the negative direction of the second time derivative value dP2 at time t4 is the third change in the negative direction during forward or advancing movement of the piston 16, whereas the change in the negative direction of the first time derivative value dP1 at time t9 is the third change in the negative direction during rearward or retracting movement of the piston 16.

Therefore, as a first process, during forward movement, the microcomputer 62 ignores the first and second changes in the negative direction at times t1 and t3 (does not execute the process of FIG. 3), and at time t4, the process of FIG. 3 may be executed with respect to the third change in the negative direction. Further, during rearward movement, the microcomputer 62 ignores the first and second changes in the negative direction at times t6 and t8 (does not execute the process of FIG. 3), and at time t9, the process of FIG. 3 may be executed with respect to the third change in the negative direction.

Further, during forward movement, the second time derivative value dP2 is maintained at a value of substantially zero during the time period from the second change in the negative direction until time t4. On the other hand, during rearward movement, the first time derivative value dP1 is maintained at a value of substantially zero during the time period from the second change in the negative direction until time t9.

Thus, as a second process, during advancing movement or retracting movement, the microcomputer 62 does not execute the process of FIG. 3 until the first time derivative value dP1 and the second time derivative value dP2 are maintained at values of substantially zero, and when the values thereof are maintained substantially at zero, execution of the process of FIG. 3 may be started.

Furthermore, times t1 and t3 are points in time immediately after output of the command signal was started, whereas times t6 and t8 are points in time immediately after output of the command signal was stopped. Thus, as a third process, the microcomputer 62 may terminate the determination process of FIG. 3 in a predetermined time period (for example, the time period from time t0 to time t3) from when output of the command signal is started at time t0, and a predetermined time period (for example, the time period from time t5 to time t8) from when output of the command signal is stopped at time t5.

Accordingly, concerning the first through third processes, by executing any one of such processes, it is possible for the microcomputer 62 to reliably detect that the piston 16 has arrived at the one end or the other end of the cylinder main body 14 at times t4 and t9.

The above-described process of FIG. 3 is a case in which pressure values of both the first pressure value P1 and the second pressure value P2 are used, and both the first pressure sensor 50 and the second pressure sensor 52 are indispensable.

In contrast thereto, the process of FIG. 5 is a process in which either one of the pressure values from among the first pressure value P1 and the second pressure value P2 is used. More specifically, in the process of FIG. 5, arrival of the piston 16 at the one end or the other end inside the cylinder main body 14 is determined using either one of the time derivative values from among the first time derivative value dP1 and the second time derivative value dP2, and by perceiving a sudden change in a positive direction or a negative direction of the time derivative value. Stated otherwise, the process of FIG. 5 is applied to a case in which only one sensor is installed from among the first pressure sensor 50 and the second pressure sensor 52, or in the case that either one of the sensors is experiencing an abnormality such as a failure or the like. Moreover, in FIG. 5, process steps which are the same as those in FIG. 3 will be described using the same step numbers.

First, a case will be described in which the first time derivative value dP1 is used.

In step S6 of FIG. 5, the microcomputer 62 calculates the first time derivative value dP1 using the first pressure value P1, and determines whether or not the first time derivative value dP1 has undergone an abrupt change in a positive direction.

In the case that the first time derivative value dP1 has undergone an abrupt change in the positive direction (step S6: YES), then in the following step S2, the microcomputer 62 determines that the piston 16 advances from the one end toward the other end inside the cylinder main body 14, and determines that the piston 16 has reached the other end at time t4, by the first time derivative value dP1 changing abruptly in the positive direction, and the absolute value thereof becoming maximum.

In addition, the microcomputer 62 generates a first end signal, and outputs the first end signal to the exterior via the input/output interface unit 60, and together therewith, displays the determination result on the display unit 66, and notifies the user concerning the arrival of the piston 16 at the first end.

On the other hand, in the case that a sudden change in a positive direction of the first time derivative value dP1 is not occurring in step S6 (step S6: NO), then in the following step S7, the microcomputer 62 determines whether or not a sudden change of the first time derivative value dP1 has occurred in a negative direction.

In the case that the first time derivative value dP1 has undergone an abrupt change in the negative direction (step S7: YES), then in the following step S4, the microcomputer 62 determines that the piston 16 retracts from the other end toward the one end inside the cylinder main body 14, whereby it is determined that the piston 16 has reached the one end at time t9, when the first time derivative value dP1 undergoes an abrupt change in the negative direction, and the absolute value thereof becomes maximum.

In addition, the microcomputer 62 generates a second end signal, and outputs the second end signal to the exterior via the input/output interface unit 60, and together therewith, displays the determination result on the display unit 66, and notifies the user concerning the arrival of the piston 16 at the second end.

In the case that a sudden change in a negative direction of the first time derivative value dP1 is not occurring (step S7: NO), then in the following step S5, the microcomputer 62 determines that the piston 16 remains at a location between the one end and the other end inside the cylinder main body 14.

In this case as well, during reciprocating motion of the piston 16, at each time that the first pressure value P1 is input thereto, the microcomputer 62 repeatedly executes the determination process of FIG. 5, and determines whether or not the piston 16 has reached the one end or the other end inside the cylinder main body 14.

Next, a case will be described in which the second time derivative value dP2 is used.

In step S6 of FIG. 5, the microcomputer 62 calculates the second time derivative value dP2 using the second pressure value P2, and determines whether or not the second time derivative value dP2 has undergone an abrupt change in a negative direction.

In the case that the second time derivative value dP2 has undergone an abrupt change in the negative direction (step S6: YES), then in the following step S2, the microcomputer 62 determines that the piston 16 advances from the one end toward the other end inside the cylinder main body 14, whereby it is determined that the piston 16 has reached the other end at time t4, when the second time derivative value dP2 undergoes an abrupt change in the negative direction, and the absolute value thereof becomes maximum.

In addition, the microcomputer 62 generates a first end signal, and outputs the first end signal to the exterior via the input/output interface unit 60, and together therewith, displays the determination result on the display unit 66, and notifies the user concerning the arrival of the piston 16 at the first end.

On the other hand, in the case that a sudden change in a negative direction of the second time derivative value dP2 is not occurring in step S6 (step S6: NO), then in the following step S7, the microcomputer 62 determines whether or not a sudden change of the second time derivative value dP2 has occurred in a positive direction.

In the case that the second time derivative value dP2 has undergone an abrupt change in the positive direction (step S7: YES), then in the following step S4, the microcomputer 62 determines that the piston 16 retracts from the other end toward the one end inside the cylinder main body 14, whereby it is determined that the piston 16 has reached the one end at time t9, when the second time derivative value dP2 undergoes an abrupt change in the positive direction, and the absolute value thereof becomes maximum.

In addition, the microcomputer 62 generates a second end signal, and outputs the second end signal to the exterior via the input/output interface unit 60, and together therewith, displays the determination result on the display unit 66, and notifies the user concerning the arrival of the piston 16 at the second end.

In the case that a sudden change in a positive direction of the second time derivative value dP2 is not occurring (step S7: NO), then in the following step S5, the microcomputer 62 determines that the piston 16 remains at a location between the one end and the other end inside the cylinder main body 14.

In this case as well, during reciprocating motion of the piston 16, at each time that the second pressure value P2 is input thereto, the microcomputer 62 repeatedly executes the determination process of FIG. 5, and determines whether or not the piston 16 has reached the one end or the other end inside the cylinder main body 14.

In the process of FIG. 5 as well, in the same manner as with the process of FIG. 3, it is preferable for the first to third processes to be executed. In this case, the first time derivative value dP1 changes in a positive direction at time t1, and the first time derivative value dP1 changes in a negative direction at times t3 and t6. In addition, the second time derivative value dP2 changes in a positive direction at time t6, and the second time derivative value dP2 changes in a negative direction at times t1 and t8.

Thus, in the first process, during forward movement, the microcomputer 62 ignores the first change in the positive direction at time t1, and the first and second changes in the negative direction at times t1 and t3 (does not execute the process of FIG. 5), and the process of FIG. 5 is executed with respect to the change in the positive direction or the negative direction at time t4. Further, during rearward movement, the microcomputer 62 ignores the first change in the positive direction at time t6, and the first and second changes in the negative direction at times t6 and t8 (does not execute the process of FIG. 5), and the process of FIG. 5 is executed with respect to the change in the positive direction or the negative direction at time t9.

Further, in the second process, during advancing movement or retracting movement, the microcomputer 62 does not execute the process of FIG. 5 until the first time derivative value dP1 and the second time derivative value dP2 are maintained at values of substantially zero, and when the values thereof are maintained substantially at zero, execution of the process of FIG. 5 is started.

Furthermore, in the third process, the microcomputer 62 terminates the determination process of FIG. 5 in a predetermined time period from when output of the command signal is started at time t0 (the time period from time t0 to time t3), and a predetermined time period from when output of the command signal is stopped at time t5 (the time period from time t5 to time t8).

Accordingly, in the process of FIG. 5 as well, by executing any one of the first to third processes, it is possible for the microcomputer 62 to reliably detect that the piston 16 has arrived at the one end or the other end of the cylinder main body 14 at times t4 and t9.

[3. Advantages and Effects of the Present Embodiment]

As was described above, in the monitoring device 10 according to the present embodiment, when the piston 16 has arrived at the one end or the other end inside the cylinder main body 14, due to the fluid being discharged from the first cylinder chamber 20 or the second cylinder chamber 22, or the fluid being supplied from the fluid supply source 42, the pressure in the first cylinder chamber 20 or the second cylinder chamber 22 changes along with the elapse of time.

Thus, attention is focused on such changes over time of the pressure, and based on the first time derivative value dP1 or the second time derivative value dP2, the microcomputer 62 determines whether or not the piston 16 has arrived at the one end or the other end inside the cylinder main body 14.

In this case, the first pressure value P1 or the second pressure value P2 of the fluid supply path (the first tube 26, the second tube 30) from the fluid supply source 42 to the first cylinder chamber 20 or the second cylinder chamber 22 is detected, whereby it becomes possible to detect the pressure value of the first cylinder chamber 20 or the second cylinder chamber 22. Therefore, it is unnecessary to install a sensor in the vicinity of the cylinder 12 for detecting the pressure. Consequently, according to the present embodiment, it is possible to detect the arrival of the piston 16 at the one end or the other end inside the cylinder main body 14 without installing a sensor in the vicinity of the cylinder 12. As a result, it is possible for the cylinder 12 to be used suitably in facilities related to food preparation, and it is possible to avoid the occurrence of corrosion or the like of sensors and wiring in a cleaning process for the facilities.

Further, in order to deal with changes in the detection level due to variations in accuracy and temperature characteristics of the first pressure sensor 50 that senses the first pressure value P1 and the second pressure sensor 52 that senses the second pressure value P2, it is possible to prevent the determination results of the microcomputer 62 from being adversely influenced by variations or the like, by determining whether or not the piston 16 has reached the one end or the other end inside the cylinder main body 14 on the basis of the first time derivative value dP1 or the second time derivative value dP2.

In this case, as in the process shown in FIG. 3, the microcomputer 62 determines that the piston 16 has arrived at the one end or the other end inside the cylinder main body 14, from a change in a negative direction of the time derivative value, when the first pressure value P1 or the second pressure value P2 changes to a pressure value (atmospheric pressure) on a side open to atmosphere. When the first pressure value P1 or the second pressure value P2 changes to atmospheric pressure, the first time derivative value dP1 or the second time derivative value dP2 abruptly changes in a negative direction along with the elapse of time. By perceiving such an abrupt change, it is possible to more accurately detect that the piston 16 has arrived at the one end or the other end inside the cylinder main body 14.

Alternatively, as in the process shown in FIG. 5, the microcomputer 62 is capable of determining that the piston 16 has arrived at the one end or the other end inside the cylinder main body 14, from a change in the first time derivative value dP1 or the second time derivative value dP2, when either one from among the first pressure value P1 and the second pressure value P2 becomes the pressure value Pv of the fluid supplied by the fluid supply source 42, or atmospheric pressure. When either one of these pressure values changes to the pressure value Pv or to atmospheric pressure, the first time derivative value dP1 or the second time derivative value dP2 changes in a positive direction or a negative direction along with the elapse of time. Thus, by perceiving such a change, it is possible to detect with good accuracy that the piston 16 has arrived at the one end or the other end inside the cylinder main body 14.

The present invention is not limited to the embodiment described above, and it is a matter of course that various alternative or additional configurations could be adopted therein without departing from the essence and gist of the present invention.

What is claimed is:

1. An operating condition monitoring device for a cylinder, in which a first cylinder chamber is formed between a piston and one end in an interior of a cylinder main body, a second cylinder chamber is formed between the piston and another end in the interior of the cylinder main body, and fluid is supplied from a fluid supply source to the first cylinder chamber, or fluid is supplied from the fluid supply source to the second cylinder chamber, whereby the piston which is connected to a piston rod undergoes reciprocating motion between the one end and the other end inside the cylinder main body, and further comprising:

a determination unit adapted to determine, based on a time derivative value of a pressure of the first cylinder chamber or the second cylinder chamber, whether or not the piston has arrived at the one end or the other end inside the cylinder main body, wherein the determination unit specifies a time derivative value of a determination target by performing a predetermined filtering process with respect to the time derivative value when the time derivative value changes a plurality of times in a positive direction or a negative direction during one reciprocating motion of the piston, and wherein the determination unit determines arrival of the piston at one end or the other end of the cylinder main body using the specified time derivative value.

2. The operating condition monitoring device for a cylinder according to claim 1, further comprising:

a first pressure detection unit adapted to detect a first pressure value inside a first tube that supplies fluid to or discharges fluid from the first cylinder chamber, and/or a second pressure detection unit adapted to detect a second pressure value inside a second tube that supplies fluid to or discharges fluid from the second cylinder chamber;

wherein the determination unit determines whether or not the piston has arrived at the one end or the other end inside the cylinder main body, based on a time derivative value of the first pressure value, which is dependent on a pressure of the first cylinder chamber, and/or a time derivative value of the second pressure value, which is dependent on a pressure of the second cylinder chamber.

3. The operating condition monitoring device for a cylinder according to claim 2, wherein the determination unit determines that the piston has arrived at the one end or the other end inside the cylinder main body, from a change in the time derivative value when the first pressure value or the second pressure value change to a pressure value on a side open to atmosphere.

4. The operating condition monitoring device for a cylinder according to claim 2, wherein the determination unit determines that the piston has arrived at the one end or the other end inside the cylinder main body, from a change in the time derivative value when either one from among the first pressure value and the second pressure value changes to a pressure value of the fluid supplied by the fluid supply source, or a pressure value on a side open to atmosphere.

* * * * *